US006346667B2

(12) United States Patent
Ishii

(10) Patent No.: US 6,346,667 B2
(45) Date of Patent: Feb. 12, 2002

(54) METHOD FOR TRANSMITTING MUSIC DATA INFORMATION, MUSIC DATA TRANSMITTER, MUSIC DATA RECEIVER AND INFORMATION STORAGE MEDIUM STORING PROGRAMMED INSTRUCTIONS FOR MUSIC DATA

(75) Inventor: Jun Ishii, Shizuoka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/768,995

(22) Filed: Jan. 24, 2001

(30) Foreign Application Priority Data

Jan. 28, 2000 (JP) ..... 12-020600

(51) Int. Cl.[7] ..... G10H 7/00
(52) U.S. Cl. ..... 84/645; 84/600
(58) Field of Search ..... 84/645, 600; 370/395

(56) References Cited

U.S. PATENT DOCUMENTS 5,532,923 A * 7/1996 Sone
5,574,949 A * 11/1996 Tsurumi
5,691,495 A * 11/1997 Fujimori ..... 84/645 X
5,734,119 A * 3/1998 France et al. ..... 84/645 X
5,933,430 A * 8/1999 Osakabe et al.

* cited by examiner

*Primary Examiner*—Jeffrey Donels
(74) *Attorney, Agent, or Firm*—Morrison & Foerster LLP

(57) ABSTRACT

MIDI data words are supplied to a data transmitter of a music data transmitting system at irregular intervals; when the data transmitter receives each of the MIDI data words, the data transmitter checks the status byte to see whether or not the status byte contains a data nibble identical with a synchronous data nibble, replaces the data nibble with another data nibble with positive answer for producing a quasi MIDI data word, supplements synchronous data nibble or nibbles between the quasi MIDI data words, and modulates a data stream containing the quasi MIDI data words and the synchronous data nibbles for synchronously transmitting the modulated signal to a data receiver of the music data transmitting system at high transfer efficiency; when the modulated signal reaches the data receiver, the data receiver demodulates the received signal, eliminates the synchronous data nibbles from the data stream, and converts the quasi MIDI data words to the MIDI data words.

22 Claims, 9 Drawing Sheets

| BIT STRING OF STATUS BYTE BEFORE DATA CONVERSION | BIT STRING AFTER DATA CONVERSION | DEFINITION OF STATUS BYTE |
|---|---|---|
| C0 | C40 | PROGRAM CHANGE AT CHANNEL 0 |
| C1 | C41 | PROGRAM CHANGE AT CHANNEL 1 |
| C2 | C42 | PROGRAM CHANGE AT CHANNEL 2 |
| ⋮ | ⋮ | ⋮ |
| CF | C4F | PROGRAM CHANGE AT CHANNEL F |
| F0 | C0 | EXCLUSIVE |
| F1 | C1 | TIME CODE QUARTER FRAME |
| F2 | C2 | SONG POSITION POINTER |
| F3 | C3 | SONG SELECT |
| F4 | C54 | ( NOT DEFINED ) |
| F5 | C55 | ( NOT DEFINED ) |
| F6 | C6 | TUNE REQUEST |
| F7 | C7 | END OF EXCLUSIVE |
| F8 | C8 | TIMING CLOCK |
| F9 | C9 | ( NOT DEFINED ) |
| FA | CA | START |
| FB | CB | CONTINUE |
| FC | CC | STOP |
| FD | CD | ( NOT DEFINED ) |
| FE | CE | ACTIVE SENSING |
| FF | CF | SYSTEM REQUEST |

Fig. 3

METHOD FOR TRANSMITTING MUSIC DATA INFORMATION, MUSIC DATA TRANSMITTER, MUSIC DATA RECEIVER AND INFORMATION STORAGE MEDIUM STORING PROGRAMMED INSTRUCTIONS FOR MUSIC DATA

FIELD OF THE INVENTION

This invention relates to music data transmitting technologies and, more particularly, to a method for transmitting music data information, a music data transmitter, a music data receiver and an information storage medium storing programmed instructions for the music data receiver.

DESCRIPTION OF THE RELATED ART

MIDI (Musical Instrument Digital Interface) is a typical example of the music data transmission standards. Data formats are standardized in the MIDI for the music data transmission. According to the MIDI standards, messages are stored in 8-bit data codes, and are transferred between the MIDI interface circuits. Plural 8-bit data codes are required for transferring each message. In other words, each message is represented by using a status byte and data bytes. In the following description, a message defined in the MIDI standards is referred to as "MIDI message".

FIG. 1 shows the plural 8-bit data codes representative of a MIDI message M. A status byte B1 is followed by data bytes B2 and B3. The status byte B1 is broken down into two parts, i.e., high-order 4 bits (1001) and low-order 4 bits (0001). The high-order 4 bits (1001) represent a binary number corresponding to a hexadecimal number [9], and the low-order 4 bits (0001) represent a binary number corresponding to a hexadecimal number [1]. In the following description, hexadecimal numbers are placed in brackets. The hexadecimal number [9] is representative of "note-on", and the hexadecimal number [1] is representative of the first channel through which the note-on event is to take place. Thus, the status byte [91] represents an instruction for generating a tone through the first channel.

The data bytes B2 and B3 give details of the instruction. The number of data bytes is predetermined for each of the status bytes. Two data bytes follow the status byte B1 representative of the instruction for generating a tone through the first channel. The first data byte B2 has a bit string (00111100) corresponding to a hexadecimal number [3C], and the hexadecimal number [3C] is indicative of the pitch of the tone to be generated. The second data byte has a bit string (01100100) corresponding to a hexadecimal number [641], and the hexadecimal number [64] is indicative of the loudness of the tone to be generated. Thus, the MIDI message M is representative of the instruction for generating the tone with the pitch [3C] at the loudness [64].

In the following description, a set of status/data bytes representative of a MIDI message is referred to as "MIDI data word". A MIDI message is stored in a MIDI data word.

While a musician is playing a tune on a musical instrument, the musical instrument generates tones in response to the keys depressed by the musician. The tones are storeable in the MIDI data words as pieces of music data information. This means that the performance is reproducible from the set of MIDI data words. When the MIDI data words are transmitted to another musical instrument, the musical instrument takes out the MIDI messages from the MIDI data words, and reproduces the tones from the MIDI messages. However, the tones are not produced at regular intervals. For this reason, the musical instruments usually communicate with each other through an asynchronous baseband transmission. In the baseband transmission, a transmitting signal is propagated through a transmission path without riding on a carrier wave. The baseband transmission requires a wide frequency range. For this reason, the MIDI data words are hardly transmitted through a communication channel assigned a narrow frequency band. This is the first problem.

The second problem is low transfer efficiency. As described hereinbefore, the MIDI message is stored in the status byte and the data bytes, and a start bit of logic "0" level and a stop bit of logic "1" level are attached to each byte as shown in FIG. 1B. The status byte and the data byte are prolonged from 8 bits to 10 bits. This results in low transfer efficiency.

SUMMARY OF THE INVENTION

It is therefore an important object of the present invention to provide a method for transmitting music data information through which pieces of music data are transmitted at high transfer efficiency.

It is also an important object of the present invention to provide a music data transmitter and a music data receiver both used in the method.

It is yet another important object of the present invention to provide an information storage medium which stores programmed instructions for the music data receiver.

To accomplish the object, the present invention proposes to employ a stuff pulse synchronization technology in the music data transmission.

In accordance with one aspect of the present invention, there is provided a method for transmitting pieces of music data information produced at irregular time intervals from a source of music data to a user comprising the steps of receiving the pieces of music data information supplied from the source of music data, supplementing pieces of synchronous data information among the pieces of music data information for producing a data stream, transmitting the data stream through a propagation path and receiving the data stream, eliminating the pieces of synchronous data information from the data stream so as to leave the pieces of music data information and supplying the pieces of music data information to the user.

In accordance with another aspect of the present invention, there is provided a music data information through a propagation path comprising 1) a first data interface for receiving the pieces of music data information supplied from a source of music data at irregular time intervals, b) a first data converter connected to the first data interface and supplementing pieces of synchronous data information among the pieces of music data information for converting the pieces of music data information to a data stream, and c) a second data interface connected to the first data converter for synchronously transmitting the data stream through the propagation path.

In accordance with yet another aspect of the present invention, there is provided a music data receiver for restoring pieces of music data information on the basis of data stream synchronously transmitted through a propagation path comprising a) a first means for eliminating pieces of synchronous data information from the data stream and b) a second means for extracting the pieces of music data information from the data stream.

In accordance with still another aspect of the present invention, there is provided an information storage medium for storing programmed instructions to be executed for restoring pieces of music data information from a data stream synchronously supplied through a propagation path, and the information storage medium containing a) a first means for eliminating pieces of synchronous data information from the data stream and b) a second means for extracting the pieces of music data information from the data stream.

BRIEF DESCRIPTION OF THE DRAWINGS

The features and advantages of the method, the music data transmitter, the music data receiver and the information storage medium will be more clearly understood from the following description taken in conjunction with the accompanying drawings in which:

FIG. 3 is a view showing a data conversion table incorporated in the music data transmitting system;

DESCRIPTION OF THE PREFERRED EMBODIMENT

Music Data Transmitting System

Figure 1A:
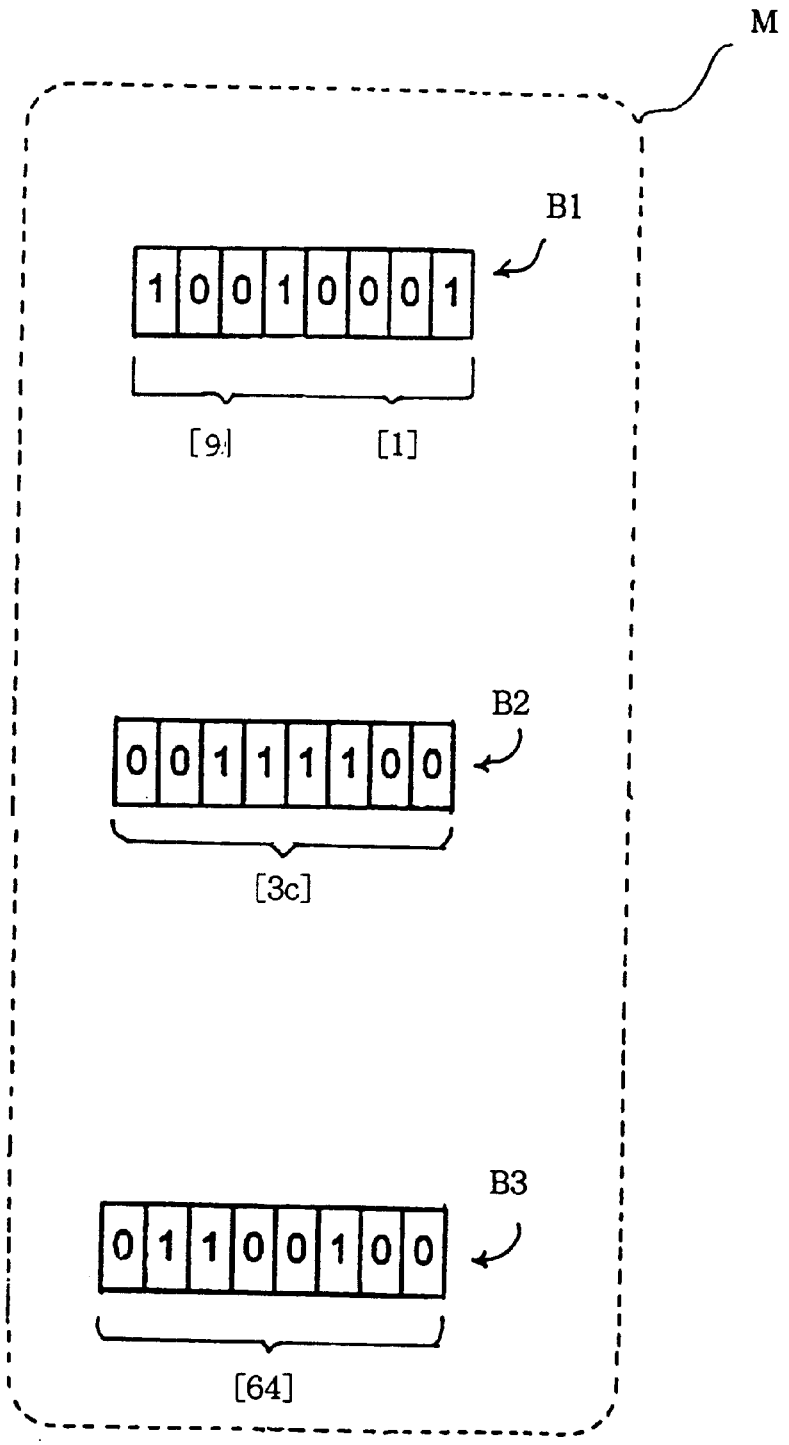
Fig. 1A PRIOR ART
FIG. 1A is a view showing the data format for the MIDI message.
Figure 1B:
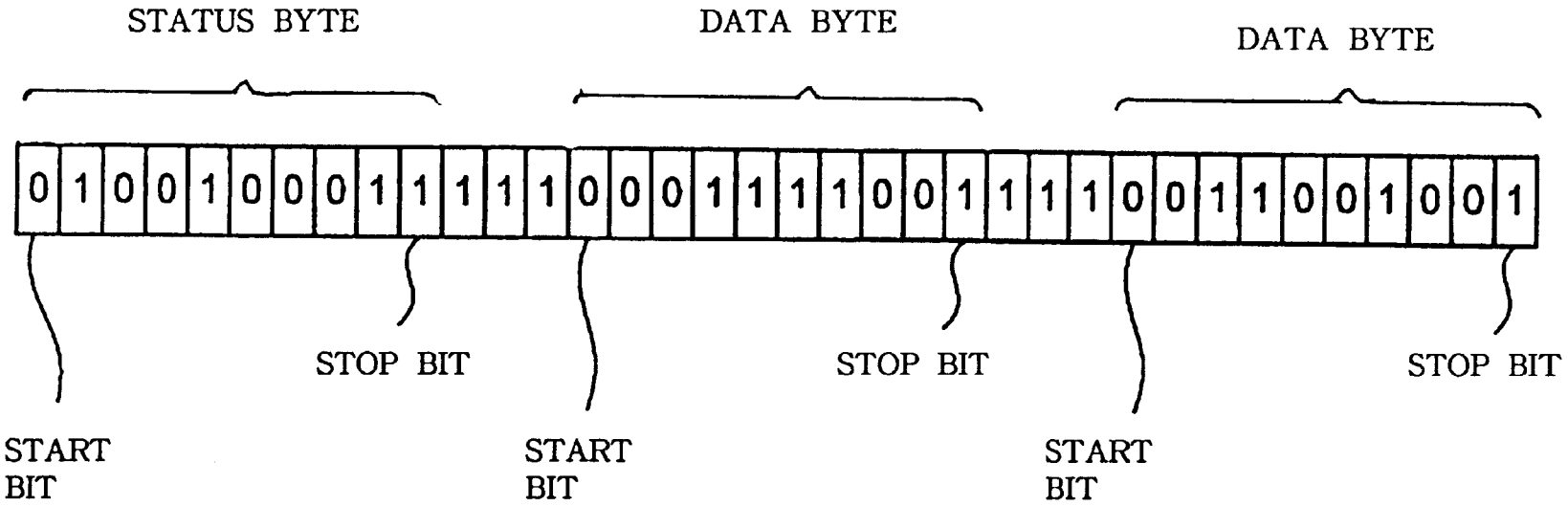
Fig. 1B PRIOR ART
FIG. 1B is a view showing a status byte and data bytes for a prior art music data transmission.
Figure 2:
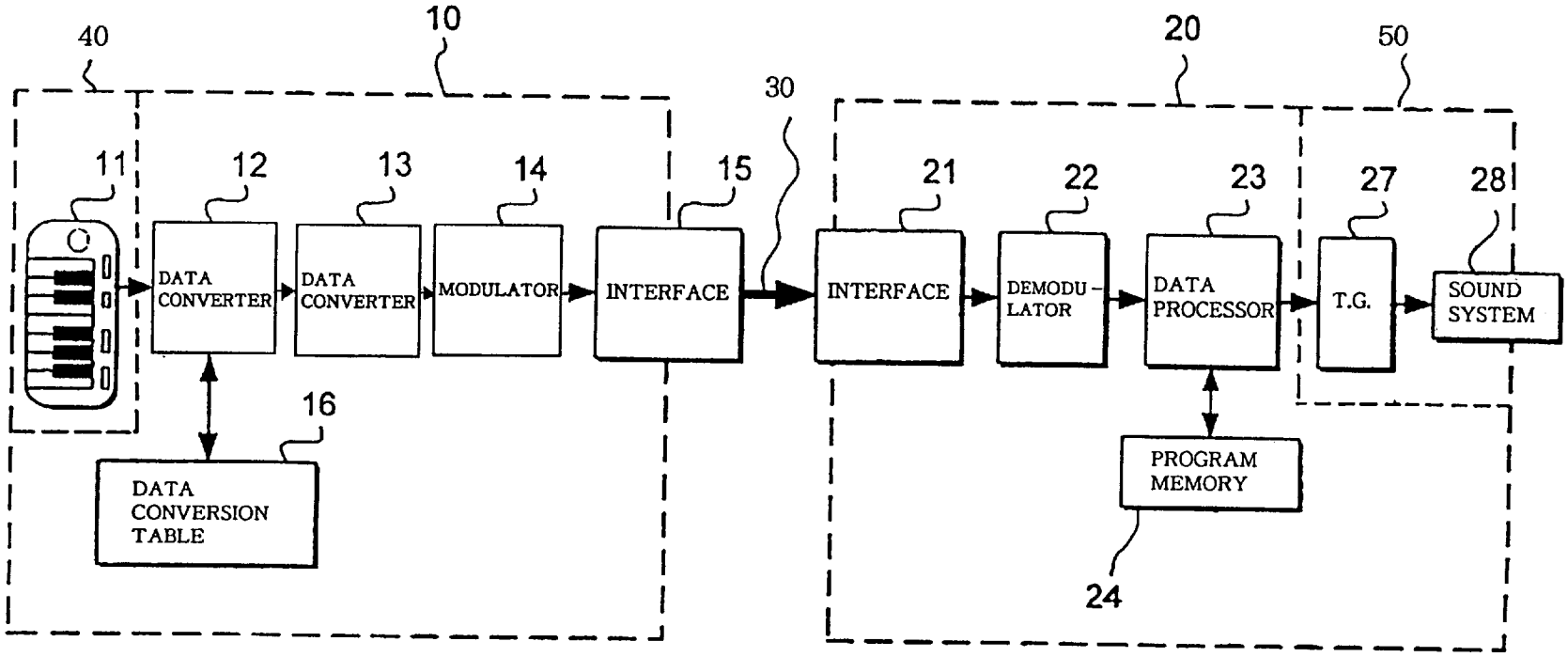
FIG. 2 is a block diagram showing a music data transmitting system according to the present invention.

Referring to FIG. 2 of FIG. 2 of the drawings, a music data transmitting system embodying the present invention largely comprises a data transmitter 10, a data receiver 20 and a communication channel 30. The music data transmitting system is connected between two musical instruments 40 and 50. In this instance, the data transmitter 10 is associated with the musical instrument 40, and the data receiver 20 is connected to the other musical instrument 50. The musical instrument 40 is implemented by an electric keyboard 11. While a musician is playing a tune on the electric keyboard 11, the electric keyboard 11 produces MIDI messages in response to the finger work, and stores the MIDI messages in MIDI data words. The MIDI data words are produced at irregular intervals, and are a kind of asynchronous data. The data transmitter 10 produces a data stream containing quasi MIDI data words from the MIDI data words, and synchronously transmits the data stream to the communication channel 30 after a suitable modulation. The modulated signal carries the data stream, and is propagated through the communication channel 30 to the data receiver 20. The data receiver 20 demodulates the received signal, and extracts the data stream from the received signal. The data receiver 20 takes out the quasi MIDI data words from the data stream, and converts the quasi MIDI data words to the MIDI data words. The data receiver 20 supplies the MIDI data words to the musical instrument. The musical instrument 50 contains a tone generator 27 and a sound system 28, and produces electronic tones from the MIDI data words. The tone generator is abbreviated as "T.G." in FIG. 2. The data transmitter 10 and the data receiver 20 are hereinbelow described in detail. Thus, the MIDI messages are synchronously transmitted through the music data transmitting system.

The data transmitter 10 includes a data converter 12, another data converter 13, a modulator 14, an interface 15 and a data conversion table 16. Plural keys, a key sensor array, a data processing system and a data interface port are incorporated in the electric keyboard 11, and the data converter 12 is connected to the data interface. The data converter 12 is connected to the data conversion table and the data converter 13, and the data converter 13 is connected through the modulator 14 to the interface 15.

A musician selectively depresses and releases the plural keys for specifying tones to be generated, and the key sensor array notifies the depressed keys and the released keys to the data processing system. The data processing system generates MIDI messages representative of the pieces of music information, i.e., the key code assigned to each depressed/released key, the key velocity and so fourth, and stores the MIDI messages in the MIDI data words. The data processing system supplies the MIDI data words through an internal bus system to the data interface port. The data converter 12 receives the MIDI data words.

The data conversion table 16 is stored in a memory device. The data conversion table 16 defines a relation between MIDI status bytes and corresponding status data codes. Although the table includes the rightmost column assigned to the definition of status byte in the MIDI standards, the data conversion table 16 only relates the most significant nibbles of the particular status bytes to the bit strings to be incorporated in the quasi MIDI data words, and the rightmost column is for the sake of reference. The particular status bytes are expressed by the bit strings equivalent to hexadecimal numbers [C0] to [CF] and [F0] to [FF]. These status bytes have the most significant nibble expressed by hexadecimal number [F] or [C]. The most significant nibble [F] is changed to the bit string equivalent to [C], and, accordingly, the most significant nibble [C] is changed to the bit string equivalent to [C4]. The status bytes [F4] and [F5] are changed to the status data codes [C54] and [C55], respectively. Thus, the most significant nibble [F] is removed from the status data codes of the quasi MIDI data words through the data conversion. This is because of the fact that the synchronous data generator requires the data nibble [F] for generating the data stream as will be described hereinlater in detail.

The reason why the most significant nibble [F] is replaced with the data nibble [C] is that only a small number of status bytes have the most significant nibble [F] and that the status bytes with the most significant nibble [F] represent system messages not frequently given in a performance. In order to discriminate the converted data nibble [C] from the data nibble [C] originally incorporated in other MIDI data words, the most significant nibble [C] of the MIDI data words is replaced with the data code equivalent to hexadecimal numbers [C4]. The status bytes with the most significant nibble [C] represent the program change, and the program change does not frequently occur. The status byte with the most significant nibble [C] is prolonged due to the data nibble [4] added thereto, and the data processing is a little bit delayed. However, the real time data processing is not required for the program change. A piece of music data information seldom follows the program change, and the delay is ignoreable. Moreover, the added data nibble [4] is so short that the quasi MIDI data words do not lower the transfer efficiency.

The status bytes [F4] and [F5] are further changed to the status data codes [C54] and [C55], respectively, because the status bytes [C0] to [CF] have been already changed to the status data codes [C4x] (x=0, 1, 2, . . . F). As will be seen in the table shown in FIG. 3, the status bytes [F4] and [F5] are not defined in the MIDI standards. There is little possibility to transmit the MIDI data words qualified with the status bytes [F4] and [F5]. However, those status bytes [F4] and [F5] may be defined in future. Moreover, it is desirable to make the conversion table clear, and the added data nibble [5] is ignoreable in the data transmission. For this reason, the status bytes [F4] and [F5] are respectively changed to the status data codes [C54] and [C55].

While the electric keyboard 11 is transferring the MIDI data words to the data converter 12, the data converter checks each MIDI data word to see whether or not the status byte is fallen into the prohibited range between [C0] and [CF] and between [F0] and [FF]. If the MIDI data word has the status byte fallen within the prohibited range, the data converter 12 accesses the data conversion table 16, and reads out the corresponding status data code from the data conversion table 16 for replacing the prohibited status byte with the read-out status data code. Upon completion of the data conversion, the MIDI data words are out of the definition of the MIDI standards. However, the MIDI message is still maintained therein. Thus, the MIDI data word is converted to the quasi MIDI data word through the data conversion. The data converter 12 supplies the quasi MIDI data word to the data converter 13. On the other hand, the data conversion does not require for the status bytes out of the prohibited range. This means that the data converter 12 does not replace the status byte with any status data code. The data converter 12 transfers the MIDI data word to the data converter 13 without the data conversion. Nevertheless, the MIDI data words are also referred to as "quasi MIDI data word" in the description on the preferred embodiment.

The data converter 13 receives the quasi MIDI data words from the data converter 12, and forms the data stream for the synchronous data transmission. Since the quasi MIDI data words intermittently reach the data converter 13, the data converter 13 supplements a synchronous data nibble equivalent to hexadecimal number [F] among the quasi MIDI data words. The data stream is supplied to the modulator 14. The modulator carries out 16 QAM (Quadrature Amplitude Modulation). The data stream is modulated through the modulator 14, and is supplied through the interface 15 to the communication channel 30 as a modulated signal. The modulated signal is propagated to the data receiver 20.

The data receiver 20 includes an interface 21, a demodulator 22, a data processor 23 and a program memory 24. The communication channel 30 is connected to the interface 21, and the data processor 23 is connected to the tone generator 27. The demodulator 22 is connected between the interface 21 and the data converter 23, and programmed instructions are sequentially supplied from the program memory 24 to the data processor 23.

The interface 21 receives the modulated signal, and transfers the modulated signal to the demodulator 22. The demodulator 22 extracts the data stream from the received signal, and supplies the data stream to the data processor 23. The data stream contains the quasi MIDI data words and the synchronous data nibble [F]. The data processor 23 accesses the program memory 24, and sequentially fetches the programmed instructions stored therein. The data processor 23 executes the programmed instructions for the following jobs. The data processor 23 firstly removes the synchronous data nibble [F] from the data stream, and converts the quasi MIDI data words to the MIDI data words. The MIDI data words are arranged at the irregular intervals as similar to the MIDI data words originally produced in the keyboard 11. The MIDI data words are supplied to the tone generator 27, and the tone generator 27 produces an audio signal on the basis of the MIDI data words. The audio signal is supplied from the tone generator 27 to the sound system 28, and electronic tones are radiated from the sound system 28 as if the tone generator 27 and the sound system 28 are incorporated in the electric keyboard 11.

Description is made on a data transmission through the music data transmitting system. Assuming now that a musician is playing a tune on the electric keyboard 11, the electric keyboard 11 produces MIDI data words representative of the performance in response to the finger work. The MIDI data words are asynchronously transferred from the electric keyboard 11 to the music data transmitting system, and are a kind of asynchronous data.

Figure 4:
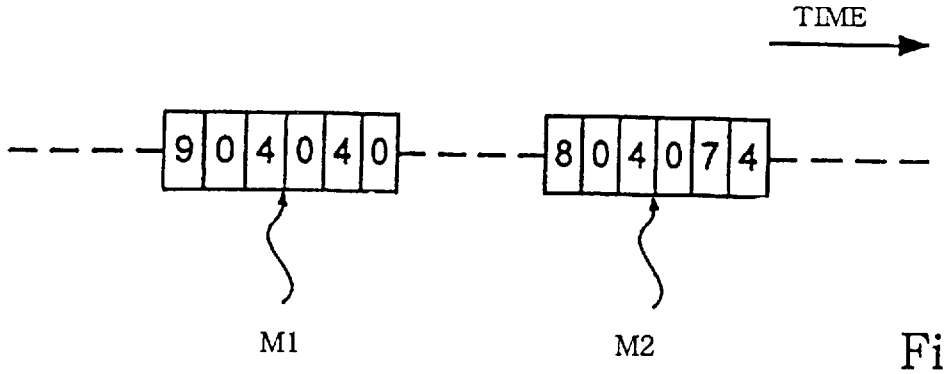
FIG. 4 is a view showing MIDI data words produced in a performance on a musical instrument.

FIG. 4 shows two of the MIDI data words representative of the MIDI messages. Time runs as indicated by an arrow. The first MIDI data word M1 is equivalent to hexadecimal number [904040], and the second MIDI data word M2 is equivalent to hexadecimal number [804074]. The MIDI data words M1 and M2 are spaced from each other and from other MIDI data words, and broken lines represents the time intervals. The data converter 12 checks the status byte to see whether or not the MIDI data word has the most significant nibble equal to hexadecimal numbers [F] or [C]. The most significant nibbles of the MIDI data words M1 and M2 are [9] and [8], and the answer is given negative. The data converter 12 does not access the data conversion table 16, and transfers the MIDI data words M1 and M2 to the next data converter 13 as the quasi MIDI data words QM1 and QM2 (see FIG. 5). The quasi MIDI data word QM2 is also spaced from each other and from the other MIDI data words as indicated by broken lines.

Figure 5:
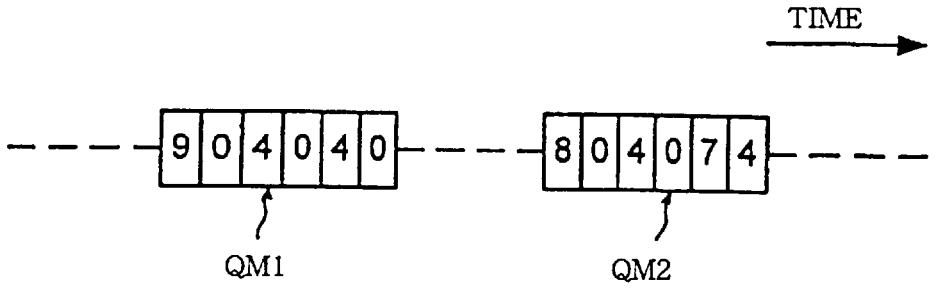
FIG. 5 is a view showing quasi MIDI data words after data conversion.
Figure 6:
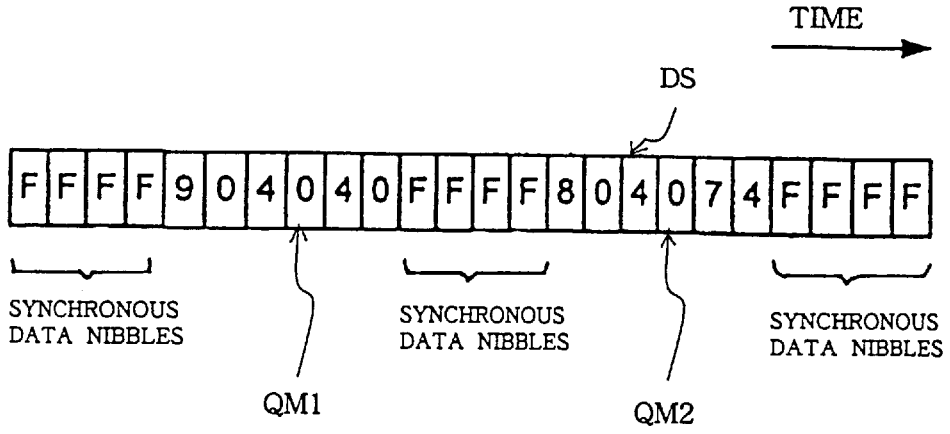
FIG. 6 is a view showing a data stream carried on a modulated signal.

The data converter 13 supplements the synchronous data nibbles [F] between the adjacent two quasi MIDI data words, and converts the quasi MIDI data words . . . , QM1, QM2, . . . to a data stream DS as shown in FIG. 5. The synchronous data nibbles [F] serve as the stuffing pulses in a justification technology, and the data stream DS is a kind of synchronous data.

Figure 7:
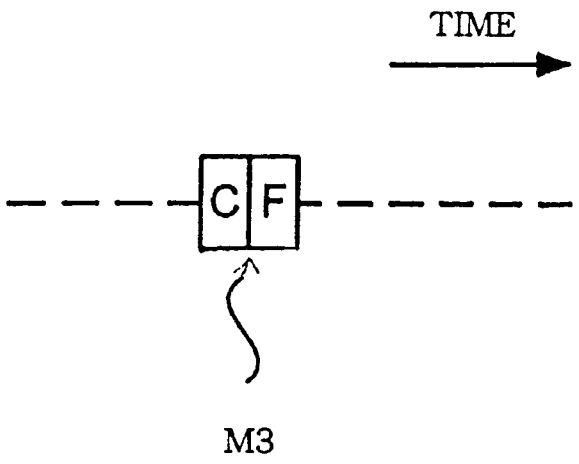
FIG. 7 is a view showing another MIDI data word produced in the performance on the musical instrument.
Figure 8:
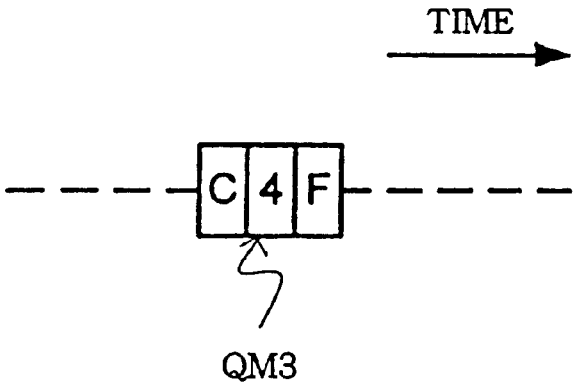
FIG. 8 is a view showing a quasi MIDI data word produced from the MIDI data word.
Figure 9:
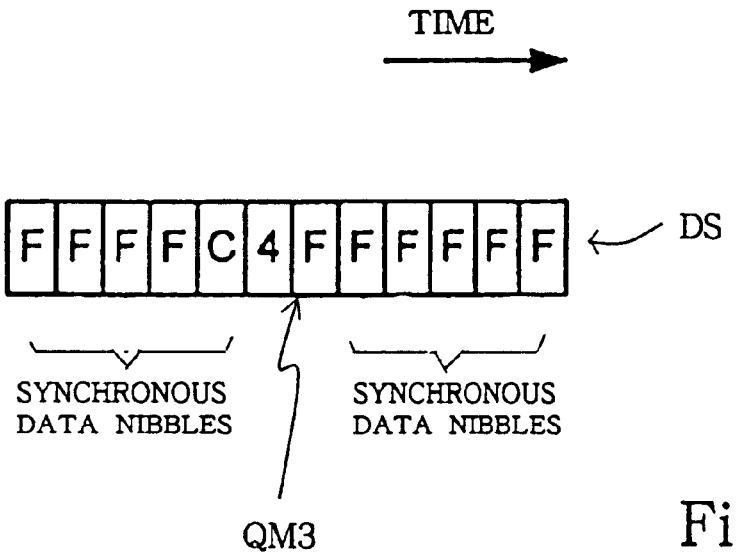
FIG. 9 is a view showing the quasi MIDI data word taken into the data stream.

After the MIDI data word M2, the electric keyboard 11 produces another MIDI data word M3 (see FIG. 7), and supplies the MIDI data word M3 to the data converter 12. The MIDI data words M3 contains the status byte [CF] representative of the program change at channel F (see FIG. 3). The data converter 12 checks the MIDI data word M4 to see whether or not the status byte is to be converted to a status data code. The status byte [CF] is fallen within the prohibit range, and the answer is given affirmative. Then, the data converter 12 accesses the data conversion table 16, and fetches the status data code [C4F] from the data conversion table 16. The data converter 12 replaces the status byte [CF] with the status data code [C4F], and produces a quasi MIDI data word QM3 as shown in FIG. 8. The data converter 12 supplies the quasi MIDI data word QM3 to the data converter 13, and data converter 13 supplements the synchronous data nibble [F] between the previous quasi MIDI data word and the quasi MIDI data word QM3 and between the quasi MIDI data word QM3 and the next MIDI data word as shown in FIG. 9. Thus, the quasi MIDI data word QM3 is taken into the data stream DS.

The data converter 13 supplies the data stream DS to the modulator 14, and the modulator 14. The data stream DS is modulated through the 16 QAM, and the modulated signal is supplied through the interface 15 to the communication channel 30. The data stream DS is propagated through the communication channel 30, and reaches the interface 21 of the data receiver 20.

The modulated signal is transferred from the interface 21 to the demodulator 22, and the demodulator 22 reproduces the data stream DS from the modulated signal. The data stream DS is supplied from the demodulator 22 to the data processor 23. The data processor 23 sequentially fetches the programmed instructions from the program memory 24. The data processor 23 takes the quasi MIDI data words from the data stream DS through execution of a computer program shown in FIG. 10, and reproduces the MIDI data words from the quasi MIDI data words as described hereinbelow in detail.

Figure 11A:
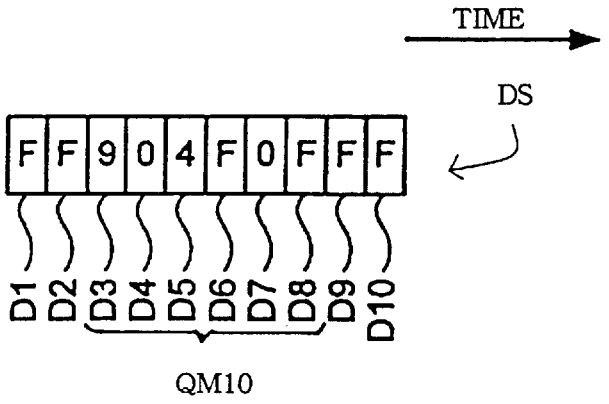
FIGS. 11A to 11C are views showing nibble streams incorporated in a data stream.
Figure 11B:
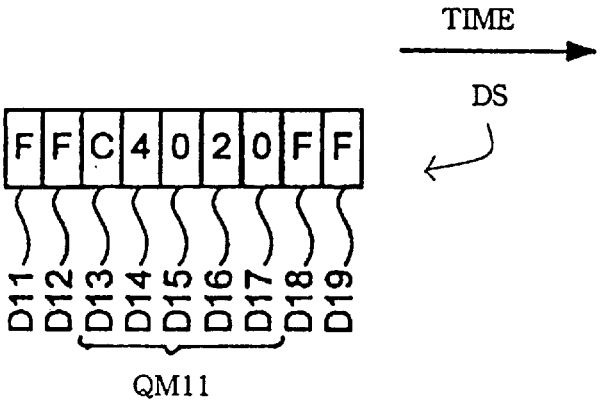
Figure 11C:
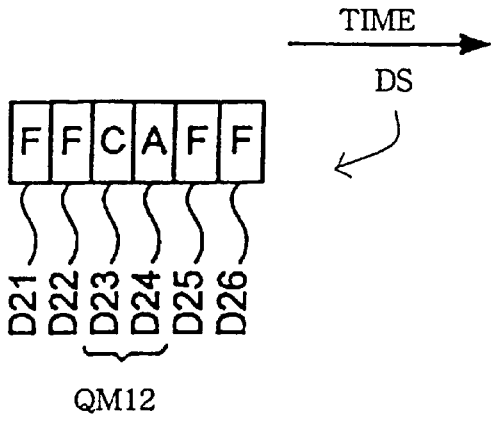

Assuming now that the data stream DS contains nibble strings D1 to D10, D11 to D19 and D21 to D26 shown in FIGS. 11A, 11B and 11C, the data processor 23 starts the execution at step SB1. The nibble string D1 to D10 contains a quasi MIDI data word QM10 equivalent to hexadecimal number [904F0F], and the other data nibbles D1, D2, D9 and D10 are the synchronous data nibbles [F]. The nibble string D11 to D19 contains another quasi MIDI data word QM11 equivalent to hexadecimal number [C4020], and the nibble string D21 to D26 contains yet another quasi MIDI data word equivalent to hexadecimal number [CA]. Other data nibbles D11, D12, D18, D19, D21, D22, D25 and D26 are the synchronous data nibbles [F].

The data processor 23 checks the data input port thereof to see whether or not any data nibble reaches the data input port as by step SB2. Before the initiation of the performance on the electric keyboard 11, the data stream DS does not reach the data input port of the data processor 23, and the answer at step SB2 is given negative. The data processor 23 checks the data input port for the data stream DS, again. Thus, the data processor 23 repeatedly executes the step SB2 until reception of the data stream DS.

When the first data nibble D1 reaches the data input port, the answer at step SB2 is changed to the positive answer, and the data processor 23 proceeds to step SB3. The data processor 23 checks the received data nibble to see whether or not the received data nibble is the synchronous data nibble [F] at step SB3. The first data nibble D1 is equivalent to hexadecimal number [F], and serves as the synchronous data nibble. Then, the data processor 23 makes a decision that the received data nibble D1 is to be ignored as by step SB4, and returns to the step SB2. Thus, the data processor 23 eliminates the synchronous data nibble [F] from the data stream DS through the loop consisting of steps SB2, SB3 and SB4, and, accordingly, a data processing for eliminating the synchronous data nibble [F] is achieved through the loop consisting of steps SB2 to SB4.

Subsequently, the second data nibble D2 reaches the data processor 23, and the data processor 23 also decides to ignore the second data nibble D2 through the loop consisting of steps SB2, SB3 and SB4.

When the third data nibble D3 reaches the data processor 23, the answers at steps SB2 is given affirmative, but the answer at step SB3 is given negative. Then, the data processor 23 checks the received data nibble to see whether or not the received data nibble is equivalent to hexadecimal number [C] as by step SB5. The third data nibble is equivalent to hexadecimal number [9], and the answer at step SB5 is given negative. The data processor 23 decides that the third data nibble D3 is the most significant nibble of the received quasi MIDI data word.

With the positive decision at step SB6, the data processor 23 proceeds to step SB20, and checks the data input port to see whether or not the next data nibble reaches. While the next data nibble does not appear, the data processor 23 repeatedly checks the data input port for the next data nibble, and waits for it. When the next data nibble reaches the data input port, the answer at step SB20 is given affirmative, and the data processor 23 determines that the received data nibble and the previous data nibble form the status byte as by step SB21. In this instance, the fourth data nibble D4 is equivalent to hexadecimal number [0], and the data processor 23 determines the status byte is equivalent to hexadecimal number [90]. The data processor 23 determines the status byte for the nibble string with the first data nibble except [C] immediately after the synchronous data nibble [F] through the data processing at steps SB5, SB6, SB20 and SB21.

Figure 12A:
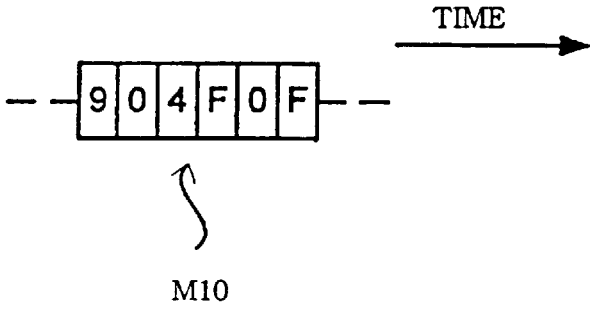
FIGS. 12A to 12C are views showing MIDI data words restored from the data stream.

The MIDI standards define the number of data bytes to follow a status byte, and the data processor 23 has a list defining the status bytes and the data bytes. The data processor 23 checks the list for the status bytes [90], and finds that two data bytes are to follow as by step SB22. The data processor 23 receives the data nibbles D5, D6, D7 and D8 as by step SB23. The quasi MIDI data word has not been subjected to the data conversion. For this reason, the data processor 23 decides that the nibble string D3 to D8 [904F0F] represents a MIDI data word M10 (see FIG. 12A) as by step SB24. Thus, the data processor 23 determines the data bytes through the data processing at steps SB22, SB23 and SB24.

Upon completion of restoration of the MIDI data word [904F0F], the data processor 23 returns to step SB2, and eliminates the synchronous data nibbles [F], D9, D10, D11 and D12 from the data stream DS through the loop consisting of steps SB2 to SB4.

When the data nibble D13 reaches the data processor 23, the answer at step SB2 is given affirmative, and the answer at step SB3 is given negative. Then, the data processor 23 proceeds to step SB5, and checks the received data nibble to see whether or not it is equivalent to hexadecimal number [C]. The received data nibble D13 is equivalent to hexadecimal number [C] (see FIG. 11B), and the answer at step SB5 is given affirmative. Then, the data processor 23 checks the data input port to see whether or not any data nibble is received as by step SB10, and waits for the next data nibble. When the next data nibble D13 reaches the data processor 23, the answer at step SB10 is given affirmative, and the data processor 23 checks the received data nibble to see whether or not it is equivalent to hexadecimal number [4] as by step SB11. The data nibble D13 is equivalent to hexadecimal number [4], and the answer at step SB11 is given affirmative. Then, the data processor 23 decides that the previous received data [C] is the most significant nibble as by step SB12.

Figure 12B:
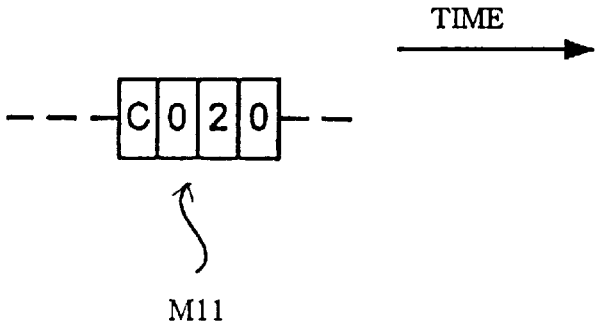

The data processor 23 waits for the next data nibble at step SB20. The next data nibble D15 is equivalent to hexadecimal number [0], and determines that the received data nibble [0] is the least significant nibble of the status byte. Therefore, the data nibble [C] and the data nibble [0] form the status byte. Thus, the data processor 23 removes the data nibble [4] from the status data code, and restores the MIDI status byte [C0] (see the first row of the data conversion table 16). The data processor 23 checks the list for the data bytes following the status byte [C0] at step SB22. Only one data byte is to follow the status byte [C0], and receives the data nibbles D16 and D17 as the data byte at step SB23. The data processor 23 determines that the nibble string D11 to D19 contains a MIDI data word M11 equivalent to hexadecimal number [C020] (see FIG. 12B) at step SB24.

Although any MIDI status byte with the most significant nibble [5] is not presently defined in the MIDI standards, the data nibble D14 equivalent to hexadecimal number [5] may reach the data processor 23. In this case, the answer at step SB11 is given negative, and the data processor 23 proceeds to step SB13. The data processor 23 checks the received data nibble to see whether or not it is equivalent to hexadecimal number [5]. The answer at step SB13 is given affirmative, and the data processor 23 determines the most significant nibble is [F] (see the tenth row and the eleventh row in the data conversion table 16) as by step SB14, and waits for the next data nibble at step SB20. The next data nibble is either [4] or [5], and the data processor 23 determines that the received data nibble [4] or [5] is the least significant nibble of the status byte at step SB21. The data processor 23 checks the list for the number of data bytes at step SB22, and receives the data byte or bytes at step SB23.

Figure 12C:
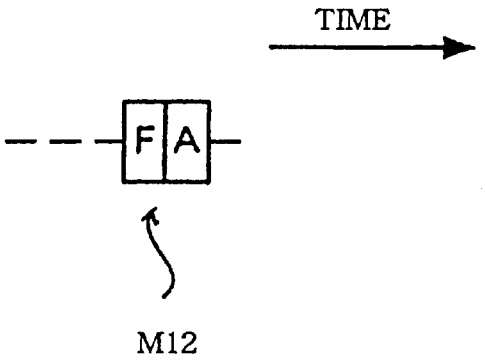

The data processor 23 eliminates the synchronous data nibbles D18, D19, D21 and D22 through the loop consisting of steps SB2, SB3 and SB4. When the data nibble D23 reaches the data processor 23, the answer at step SB2 is given affirmative. The received data nibble D23 is equivalent to hexadecimal number [C], and the answer at step SB3 and the answer at step SB5 are given negative and affirmative, respectively. Then, the data processor 23 waits for the next data nibble D24 at step SB10. The data nibble D24 is equivalent to hexadecimal number [A], and the answers at steps SB11 and SB13 are given negative. Then, the data processor 23 proceeds to step SB15, and determines the data nibble [F] and the presently received data nibble D24 form the status byte as by step SB15 (see the sixteenth row of the data conversion table 16), and checks the list for the number of data bytes at step SB22. The status byte [FA] means the instruction "start", and any data byte does not follow the status byte. For this reason, the data processor 23 determines that the nibble string D21 to D26 contain a MIDI data word M12 equivalent to hexadecimal number [FA] (see FIG. 12C) at step SB24.

The data processor 23 eliminates the synchronous data nibbles D25 and D26 through the loop consisting of steps SB2 to SB4, and waits for the next data nibble.

The MIDI data words M10, M11 and M12 are supplied to the tone generator 27 in a real time fashion, and tone generator 27 produces the audio signal from the MIDI data words. The audio signal is supplied to the sound system 28, and electronic tones are radiated from the sound system as if the tones are generated by the electric keyboard 11.

Thus, the data processor 23 determines the status byte through the data processing at steps SB5, SB6, SB10 to SB15, SB20 and SB21. For this reason, the data processing at these steps SB5, SB6, SB10 to SB15, SB20 and SB21 is referred to as "data processing for determining a status byte". As described hereinbefore, the data processor 23 determines the data bytes through the data processing at steps SB22 to SB24, and is referred to as "data processing for determining data bytes". The MIDI data word is restored through the data processing at steps SB5, SB6, SB10 to SB15 and SP20 to SB24. Thus, the data processing for restoring a MIDI data word is broken down into the data processing for determining a status byte and the data processing for determining data bytes.

Figure 10:
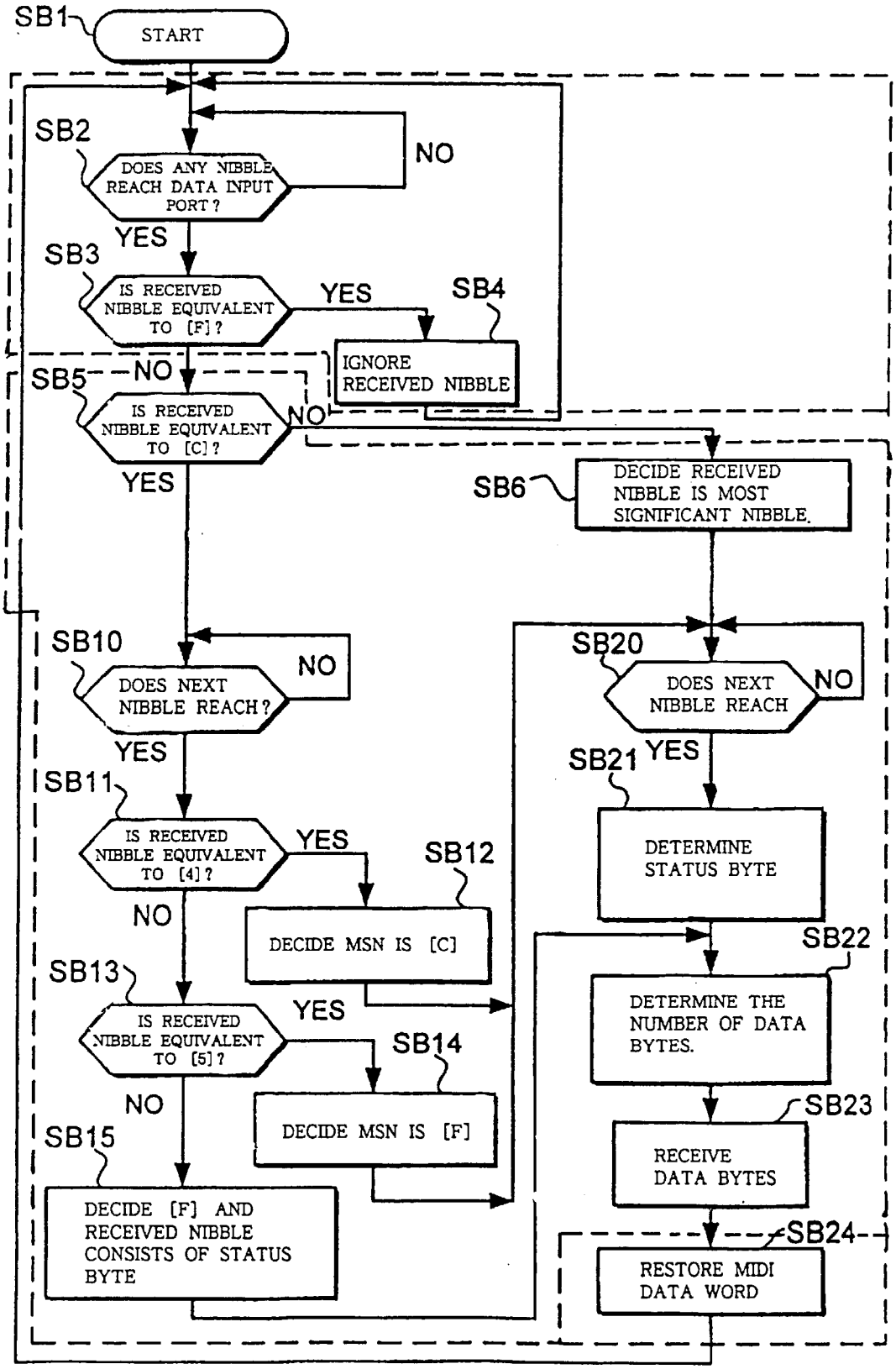
FIG. 10 is a flowchart showing a computer program executed by a data processor incorporated in the music data transmitting system.
Figure 13:
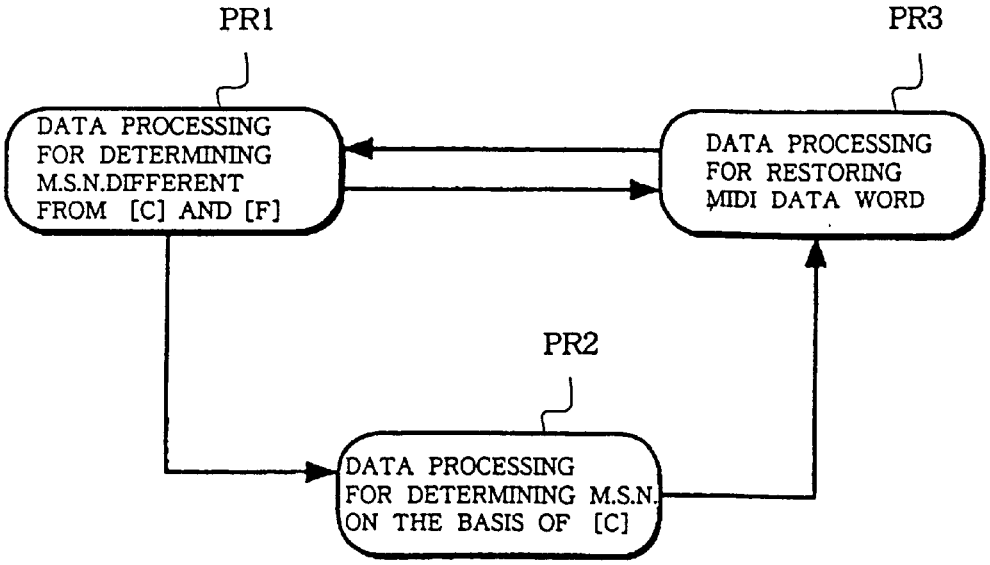
FIG. 13 is a view showing a concept for the music data transmitting method from another aspect.

As described hereinbefore, the most significant nibbles [C] and [F] are converted to the data codes [C4], [C] and [C5] before the data transmission. Therefore, the method shown in FIG. 10 is broken down into a data processing PR1 for determining the most significant nibble different from the data nibbles [C] and [F], a data processing PR2 for determining the most significant nibble on the basis of the data nibble [C] and a data processing PR3 for restoring a MIDI data word. The data processing PR1 is carried out at steps SB2, SB3, SB4, SB5 and SB6, and the data processing PR2 is carried out at steps SB10 to SB15. The data processing RP3 is carried out at steps SB20 to SB24. When the most significant nibble is determined through the data processing PR1, the data processor 23 directly proceeds to the data processing PR3, and returns from the data processing PR3 to the data processing PR1 (see FIG. 13). However, if the most significant nibble is not determined through the data processing PR1, the data processor 23 determines the most significant nibble through the data processing PR2, and, thereafter, proceeds to the data processing PR3.

In the above-described embodiment, the synchronous data nibbles [F] serve as pieces of synchronous data information, and the MIDI messages are pieces of music data information.

As will be appreciated from the foregoing description, the synchronous data nibbles are supplemented to the time intervals between the MIDI data words for synchronously transferring the continuous data stream through a communication line, and the synchronous data nibbles are eliminated from the continuous data stream after the reception. Neither start bit nor stop bit is required for each of the MIDI data word. For this reason, the MIDI messages are transferred at high transfer efficiency.

Moreover, the data stream DS is subjected to the modulation before the data transmission, and is restored through the demodulation. This results in that the music data transmitting system merely requires a narrow band for the music data transmission, and a public communication line is available for the music data transmission according to the present invention.

Although particular embodiments of the present invention have been shown and described, it will be apparent to those skilled in the art that various changes and modifications may be made without departing from the spirit and scope of the present invention.

For example, a musical instrument may have a built-in data transmitter and/or the data receiver according to the present invention.

The computer programs may be stored in a portable information storage medium such as, for example, a CD-ROM (Compact Disk Read Only Memory) or a floppy disk. Otherwise, the computer programs may be stored in a memory unit incorporated in a computer system of a provider. In this instance, the computer programs are downloaded to the music data transmitting system according to the present invention through a communication line.

The data processor 23 may supply the MIDI data words in a suitable data storage. In this instance, when a user requests the data processor 23 to reproduce the performance, the MIDI data words are read out from the data storage, and are transferred to the tone generator 28.

The synchronous data nibble may be equivalent to another hexadecimal number [0] to [E]. When another hexadecimal number is employed, the data conversion table is changed. The piece of synchronous data information may be expressed by another data code such as, for example, a byte or a word. The present invention never sets a limit on the data length of the synchronous data code.

The present invention never sets a limit of the musical instruments 40/50. An automatic player piano, a sequencer and/or any kind of electric musical instrument may be connected to the music data transmitting system according to the present invention. The musical instrument 40 may be a data storage of a personal computer for storing MIDI data words or an electronic music score for displaying notes in the staff notation.

The music data codes may be formatted in accordance with another kind of standards.

What is claimed is:

1. A method for transmitting pieces of music data information produced at irregular time intervals from a source of music data to a user, comprising the steps of:

a) receiving said pieces of music data information supplied from said source of music data;

b) supplementing pieces of synchronous data information among said pieces of music data information for producing a data stream;

c) transmitting said data stream through a propagation path;

d) receiving said data stream;

e) eliminating said pieces of synchronous data information from said data stream so as to leave said pieces of music data information; and f) supplying said pieces of music data information to said user.

2. The method as set forth in claim 1, in which said step b) includes the sub-steps of b-1) determining whether or not part of expression of each of said pieces of music data information is identical with expression of each of said pieces of synchronous data information, b-2) replacing said part of said expression with another expression different from said expression of said each of said pieces of synchronous data information when an answer is given affirmative at said sub-step b-1), b-3) deciding said expression of said each of said pieces of music data information to be maintained without the execution of said sub-step b-2) when said answer is given negative at said sub-step b-1), and b-4) inserting said pieces of synchronous data information among said pieces of music data information after the execution of either sub-step b-2) or b-3).

3. The method as set forth in claim 2, in which said expression of said each of said pieces of music data information is standardized in accordance with MIDI standards.

4. The method as set forth in claim 3, in which said part of said expression is a status byte forming a part of a MIDI data word.

5. The method as set forth in claim 4, in which at least one of said pieces of synchronous data information is inserted in a time interval between a previous MIDI data word and said status byte of said MIDI data word in said step b-4).

6. The method as set forth in claim 5, in which at least one of said pieces of synchronous data information is a four-bit data code.

7. The method as set forth in claim 1, in which said steps c) and d) respectively include the sub-steps of c-1) modulating said data stream for producing a modulated signal, and c-2) supplying said modulated signal to said propagation path, and the sub-steps of d-1) demodulating said modulated signal for restoring said data stream.

8. The method as set forth in claim 7, in which said data stream is modulated through a quadrature amplitude modulation technique.

9. The method as set forth in claim 1, in which said step e) includes the sub-steps of e-1) checking said data stream to see whether expression of each piece of said data stream is identical with expression of each of said pieces of synchronous data information, e-2) eliminating said piece from said data piece when an answer at said sub-step e-1) is given affirmative, and e-3) extracting said piece from said data piece without the execution at said sub-step e-2) for leaving said piece as one of said pieces of music data information when the answer at said sub-step e-1) is given negative.

10. The method as set forth in claim 1, in which said pieces of music data information are standardized in accordance with MIDI standards.

11. The method as set forth in claim 10, in which said step e) includes the sub-steps of e-1) checking said data stream to see whether expression of each piece of said data stream is identical with expression of each of said pieces of synchronous data information, e-2) eliminating said piece from said data piece when an answer at said sub-step e-1) is given affirmative, and e-3) extracting said piece from said data piece without the execution at said sub-step e-2) for leaving said piece as one of said pieces of music data information when the answer at said sub-step e-1) is given negative.

12. The method as set forth in claim 11, in which said sub-step e-3) includes the sub-steps of e-3-1) determining a status byte on the basis of said each piece of said data stream and the next piece or pieces of said data stream, e-3-2) determining the number of data bytes defined in said MIDI standards for said status byte, e-3-3) receiving a number of pieces of said data stream as said data bytes, and e-3-4) restoring said one of said pieces of music data information containing said status byte and said data bytes.

13. A music data transmitter for transmitting pieces of music data information through a propagation path, comprising:

a) a first data interface for receiving said pieces of music data information supplied from a source of music data at irregular time intervals;

b) a first data converter connected to said first data interface, and supplementing pieces of synchronous data information among said pieces of music data information for converting said pieces of music data information to a data stream; and c) a second data interface connected to said first data converter for synchronously transmitting said data stream through said propagation path.

14. The music data transmitter as set forth in claim 13, further comprising a second data converter connected between said first data interface and said first data converter, checking each of said pieces of music data information to see whether or not part of expression of said each of said pieces of music data information is identical with expression of each of said pieces of synchronous data information and replacing said part of said expression with another expression different from said expression of said each of said pieces of synchronous data information with a positive answer.

15. The music data transmitter as set forth in claim 14, further comprising a modulator connected between said first data converter and said second data interface and modulating said data stream for producing a modulated signal so that said data stream is transmitted as said modulated signal.

16. A music data receiver for restoring pieces of music data information on the basis of a data stream synchronously transmitted through a propagation path, comprising:

a) a first means for eliminating pieces of synchronous data information from said data stream; and b) a second means for extracting said pieces of music data information from said data stream.

17. The music data receiver as set forth in claim 16, in which said first and second means are implemented by a data processor executing programmed instructions.

18. The music data receiver as set forth in claim 17, further comprising a demodulator connected between said propagation path and said data processor for restoring said data stream from a modulated signal.

19. The music data receiver as set forth in claim 16, in which said pieces of music data information are standardized in accordance with MIDI standards.

20. The music data receiver as set forth in claim 19, in which said second means includes a first sub-means for determining a status byte on the basis of each piece of said data stream and the next piece or pieces of said data stream after elimination of said pieces of synchronous data information, a second sub-means for determining the number of data bytes defined in said MIDI standards for said status byte, a third sub-means for receiving a number of pieces of said data stream as said data bytes, and a fourth sub-means for restoring one of said pieces of music data information containing said status byte and said data bytes.

21. An information storage medium for storing programmed instructions to be executed for restoring pieces of music data information from a data stream synchronously supplied through a propagation path, comprising:

a) a first means for eliminating pieces of synchronous data information from said data stream; and b) a second means for extracting said pieces of music data information from said data stream.

22. The information storage medium as set forth in claim 21, in which said second means includes a first sub-means for determining a status byte on the basis of each piece of said data stream and the next piece or pieces of said data stream after elimination of said pieces of synchronous data information, a second sub-means for determining the number of data bytes defined in said MIDI standards for said status byte, a third sub-means for receiving a number of pieces of said data stream as said data bytes, and a fourth sub-means for restoring one of said pieces of music data information containing said status byte and said data bytes.

* * * * *